United States Patent [19]

Poirier

[11] Patent Number: 4,538,815

[45] Date of Patent: Sep. 3, 1985

[54] GOLF STANCE GUAGE

[76] Inventor: Ronald G. Poirier, 56 Harbor Ave., Nashua, N.H. 03060

[21] Appl. No.: 603,728

[22] Filed: Apr. 25, 1984

[51] Int. Cl.[3] ..... A63B 69/36

[52] U.S. Cl. ..... 273/187 R

[58] Field of Search ..... 273/187 R, 187 A, 187 B, 273/183 A, 186 R, 195 R; 434/252

[56] References Cited

U.S. PATENT DOCUMENTS

| | | | |
|---|---|---|---|
| 2,150,580 | 3/1939 | Crowley | 273/187 R |
| 3,658,344 | 4/1972 | Kimble | 273/187 R |

FOREIGN PATENT DOCUMENTS

| | | | |
|---|---|---|---|
| 1293714 | 10/1972 | United Kingdom | 273/187 R |
| 1461508 | 1/1977 | United Kingdom | 273/187 R |

*Primary Examiner*—George J. Marlo

*Attorney, Agent, or Firm*—Irving M. Kriegsman

[57] ABSTRACT

A golf stance guage for use in assisting a golfer in repeatedly obtaining the proper stance and distance from a golf ball for different size and types of golf clubs so that the golfer repeatedly can hit the ball in the same direction is disclosed. The device comprises a longitudinally adjustable foot positioning frame which is adapted to rest on the ground and be secured in place. A first ball marker member which is longitudinally adjustable is pivotally connected at one end to the foot positioning frame, the location on the foot positioning frame where it is attached being along the axis of the intended ball position for the driver club and depending on whether the golfer is right handed or left handed. A second ball marker member is slidably mounted on the first ball marker member and extends outward therefrom at right angles. Markings are recorded on the first and second ball marker members for use in locating the position of the ball relative to the foot positioning frame for golf clubs of interest, the markings being put on by the golfer himself, initially, through a trial and error calibration technique.

5 Claims, 4 Drawing Figures

GOLF STANCE GUAGE

BACKGROUND OF THE INVENTION

The present invention relates generally to golf stance guages and more particularly to golf stance guage for use in assisting a golfer to repeatedly position a golf ball at the proper location relative to his feet.

In U.S. Pat. No. 3,658,344 to Q. Kimble there is disclosed a golfer's stance aid for locating the feet of the golfer properly with respect to a golf ball. The device comprises a linear member adapted to rest on the ground, having foot pads adjustable angularly as well as lengthwise of the linear member. Spikes anchor the foot pads in the ground. An extensible member extends laterally outwardly from the linear member to the golf ball. The extensible member has an arm pivoted at its inner end to the midpoint of the linear member, and also has an elongated bar formed by a single strand or wire having coextensive elements shaped to provide a series of openings along its length. These openings are adapted to receive a fastener in the outer end of the arm so that the strand or wire may be connected to the arm through any one of the openings and thereby vary the length of the extensible member. The strand or wire terminates at its outer end in a loop for receiving a golfer tee and a pointer.

In U.S. Pat. No. 3,244,421 to W. M. Hanna there is disclosed a golf stance corrector consisting of a first front foot plate, a first elongated member rigidly fixed to and projecting laterally from said foot plate, a second elongated member telescopically associated with the first elongated member and being longitudinally adjustable relative thereto, means for releasably fixing the second member to the first member in a plurality of longitudinally adjusted positions, a second rear foot plate, and laterally adjustable mounting means releasably fixing the second foot plate to the outer end of the second elongated member at any one of a plurality of laterally spaced positions relative to said outer end.

In U.S. Pat. No. 2,886,326 to C. E. Olds there is disclosed A golfer's stance guage comprising: a foot spacing section having inner and outer mutually telescoping portions, the terminal ends of said portions being adapted to be positioned in use at the forward ends of the golfer's shoes, said portions of said foot spacing section having mutually cooperating guage indicia for determining the extend of said telescoping, and a ball spacing sections extending forwardly from and transversely of said foot spacing section, said ball spacing section comprising forward and rearward mutually telescoping portions, means slidably connecting the rearward end of the rearward portion of said ball spacing section to said outer portion of said foot spacing section in a manner whereby said rearward portion of said foot spacing section only longitudinally of said outer portion of said foot spacing section, and said portions of said ball spacing section also having mutually cooperating gauge indicia thereon for determining the extent of said telescoping.

In U.S. Pat. No. 1,922,130 to O. P. Haserodt there is disclosed a golf appliance comprising a calibrated rule adapted to be placed in flat contact with the fairway and to be anchored thereon, the same including a body having a straight edge substantially in longitudinal alinement with the direction of the stroke, and at the opposite edge being inclined with respect to the said line, to facilitate proper placement of the feet, a golf ball position indicator carried by the intermediate portion of said rule, said indicator being in the nature of an adjustable pointed graduated strip disposed at right angles to said straight edge.

In U.S. Pat. No. 3,300,219 to S. G. Sipos there is disclosed a training device for golfers comprising a straight base, an elongated straight leg joined to and extending normal from said base and having a longitudinal series of spaced apart openings therein, a golf ball tee having a stem insertable in any one of said leg openings for positioning said tee on said leg, and a pair of shoe guides each joined to an opposite end of said base and diverging from one another, each of said shoe guides having an interior opening defined by a wall of said guide having the configuration of the sole of a shoe.

Other known patents of interest include U.S. Pat. No. 3,384,377, to R. L. Stipp; U.S. Pat. No. 3,868,116 to D. M. Ford et al; U.S. Pat. No. 1,517,555 to L. V. Graham and U.S. Pat. No. 3,638,950 to W. K. Hyotlaine.

It is an object of this invention to provide a new and improved golf stance guage.

It is another object of this invention to provide a golf stance guage which enables a golfer to learn the proper stance.

It is still another object of this invention to provide a golf stance guage which enables the golfer to repeatedly position the ball at the proper location.

It is yet still another object of this invention to provide a golf stance guage which can be used by left or right handed golfers.

It is a further object of this invention to provide a golf stance guage which can be used with a variety of different size and types of golf clubs.

It is another object of this invention to provide a golf stance guage which is safe to use and will not interfer with the ball or club when the ball is being hit.

It is still another object of this invention to provide a golf stance guage which can be personally calibrated by the golfer.

It is yet still another object of this invention to provide a golf stance guage which is easy to assemble and use.

SUMMARY OF THE INVENTION

A golf stance guage for use in assisting a golfer in learning the proper stance and distance from a golf ball constructed according to the teachings of the present invention comprise a foot positioning frame adapted to rest on the ground, said foot positioning frame being adjustable in length, a first ball marker member extending laterally outward from said foot positioning frame, said first ball marker member having an inner end and an outer end and being adjustable in length, means for pivotally attaching the inner end of said first ball marker member to said foot positioning frame, and a second ball marker member on said first ball marker member and extending laterally outward therefrom at right angles thereto, whereby said gold ball can be properly positioned relative to said foot positioning frame using said first and second ball marker members to record markings indicating the desired position of said ball.

Various features and advantages will appear from the description to follow. In the description, reference is made to the accompanying drawing which forms a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENT

Figure 1:
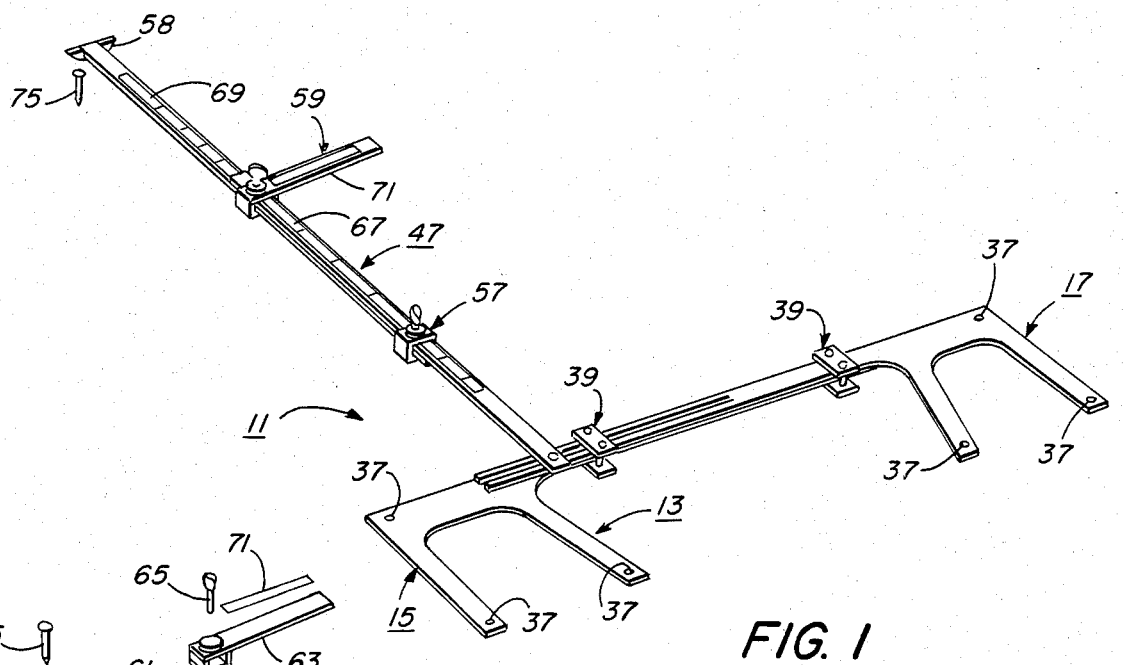
FIG. 1 is a perspective view of a golf stance guage constructed according to the teachings of the present invention.
Figure 2:
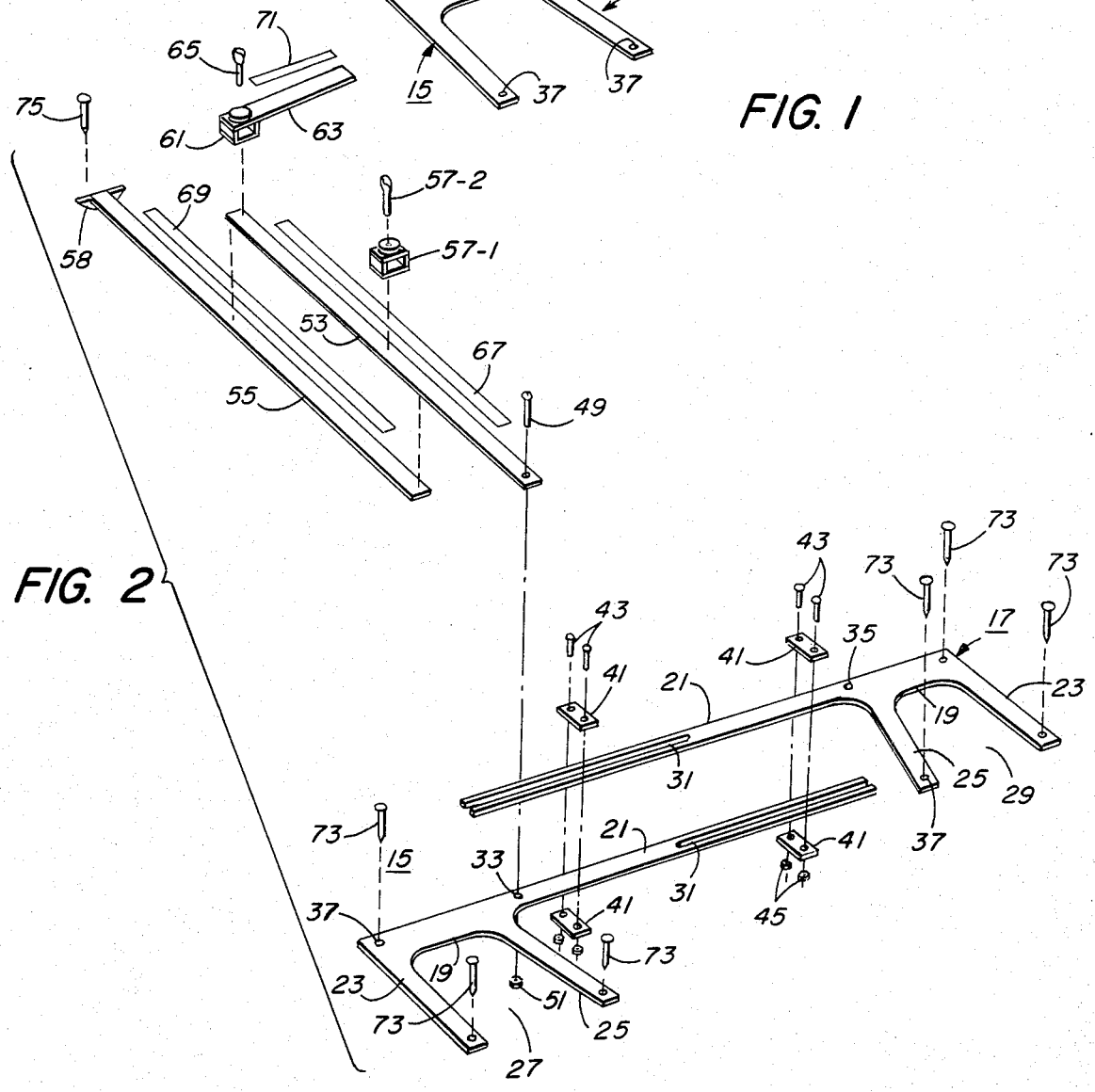
FIG. 2 is an exploded view showing the parts of the device separated from one another.

Referring now to the drawings there is shown in FIG. 1 a golf stance guage constructed according to the teachings of the present invention and identified generally by reference numeral 11. For illustrative purposes, the golf stance guage 11 is shown in FIG. 1 as assembled for use with a right handed golfer. The parts making up golf stance aid 11 are shown separately in FIG. 2.

Golf stance aid 11 includes a foot positioning frame 13 which is longitudinally adjustable to accommodate different sized golfers. Foot positioning frame 13 includes a left frame member 15 and a right frame member 17 which are equal in size and shape. Each frame member 15 and 17 includes a base 19, a longitudinally extending leg 21 and a pair of transversely extending legs 23 and 25 which along with base 19 define a foot receiving area, the foot receiving area in left frame member 15 being identified by reference numeral 27 and the foot receiving area in right frame member 17 being identified by reference numeral 29. Each foot receiving area is sized to accommodate various stances. Each longitudinal leg 21 includes a longitudinal open ended slot 31. The outer leg 23 in each frame member 15, 17 is disposed at right angles to its respective base portion while the inner leg 25 in each frame member 15, 17 is angled outward. Left frame member 15 includes a pivot pin hole 33 for use in assembling the device for a right handed golfer while right frame member 17 includes a pivot pin hole 35 for use in assembling the device for a right handed golfer. Pivot pin hole 33 is located relative to foot receiving area 27 so that it will be along the axis where the ball should be located for use with a driver club for a right handed golfer. Similarly, pivot pin hole 35 is located relative to foot receiving area 29 so that it will be along the axis where the ball should be located for a left handed golfer. Each frame member 15, 17 also includes a plurality of tie down holes 37 for use in securing the frame to the ground. Frame members 15 and 17 are made of wood, metal, plastic, fiberglass or any other relatively flexible material.

Frame members 15 and 17 are clamped together in overlapping relationship by a pair of clamp or bracket assemblies 39. Each bracket assembly 39 includes a pair of plates 41, a pair of bolts 43 and a pair of nuts 45.

Golf stance guage 11 further includes a first ball marker member 47 which is longitudinally adjustable and which is pivotally attached at its inner end to foot positioning frame 13 at pivot pin hole 33 by means of a bolt 49 and a nut 51.

First ball marker member 47 includes a first or inner elongated member 53, a second or outer elongated member 55 and a bracket assembly 57 for clamping the two elongated members together in overlapping relationship. Bracket assembly 57 may comprise a sleeve 57-1 and a thumbscrew 57-2. Inner and outer members 53 and 55 may be made of the same material as frame members 15 and 17. A slide or runner member 58 is secured to the outer end of second member 55 to enable easy pivotal movement of first ball marker member 47.

A second ball marker member 59 is slidably mounted on first ball marker member 47 and extends outwardly therefrom at right angles. Second ball marker member 59 includes a sleeve portion 61 which rides on first ball marker member 47 and a leg portion 63. A thumbscrew 65 extends through a threaded hole in sleeve portion 61 for securing second ball marker 59 in place at any location along the length of first ball marker member 47. Second ball marker member 59 may be made of the same material as first ball marker member 47.

Adhesive backed blank overlay strips 67, 69 and 71 are secured to the top surfaces of inner member 53, outermember 55 and leg portion 63, respectively for use in recording markings representing ball locations for different clubs as will be hereinafter explained.

Finally, golf stance guage includes a plurality of tie down pins 73 for use in securing foot positioning frame 13 to the ground and a pin 75 for use in resetting first ball marker member 47 to its open (right angle) position.

Golf stance guage 11 is adjusted and calibrated in the following manner.

First, ball marker member 47 is pivotally attached to foot positioning frame 13, using pivot pin hole 33 if the golger is a right handed golfer and pivot pin hole 35 if the golfer is a left handed golfer. Left and right frame members 15 and 17 are then adjusted longitudinally relative to each other to provide the appropriate foot spacing for the golfer and secured in place at that length by clamps 39.

Golf stance guage 11 is then ready for calibration.

Figure 3:
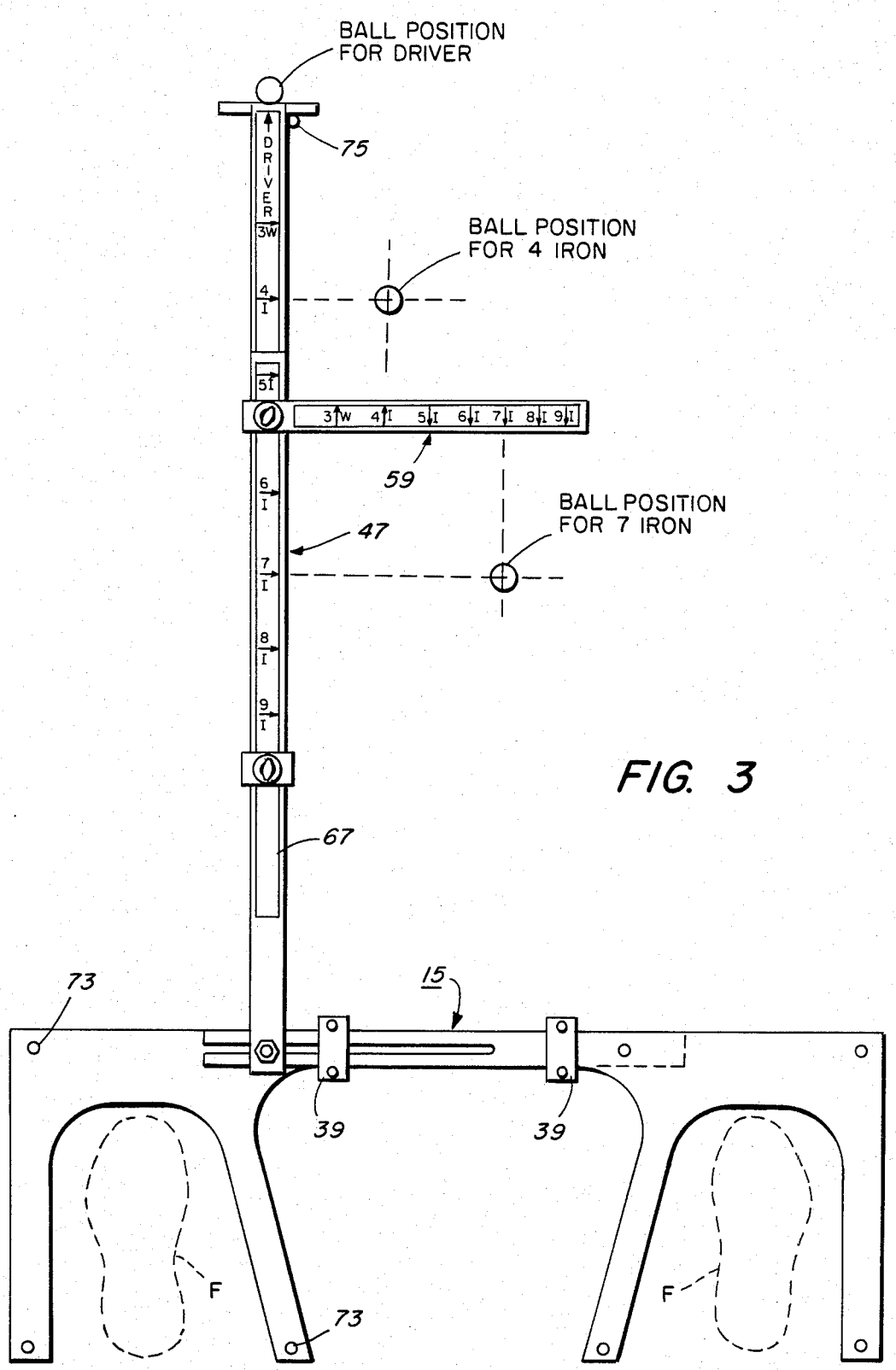
FIG. 3 is a plan view showing how the device is arranged during calibration and when it is being used to position a ball.
Figure 4:
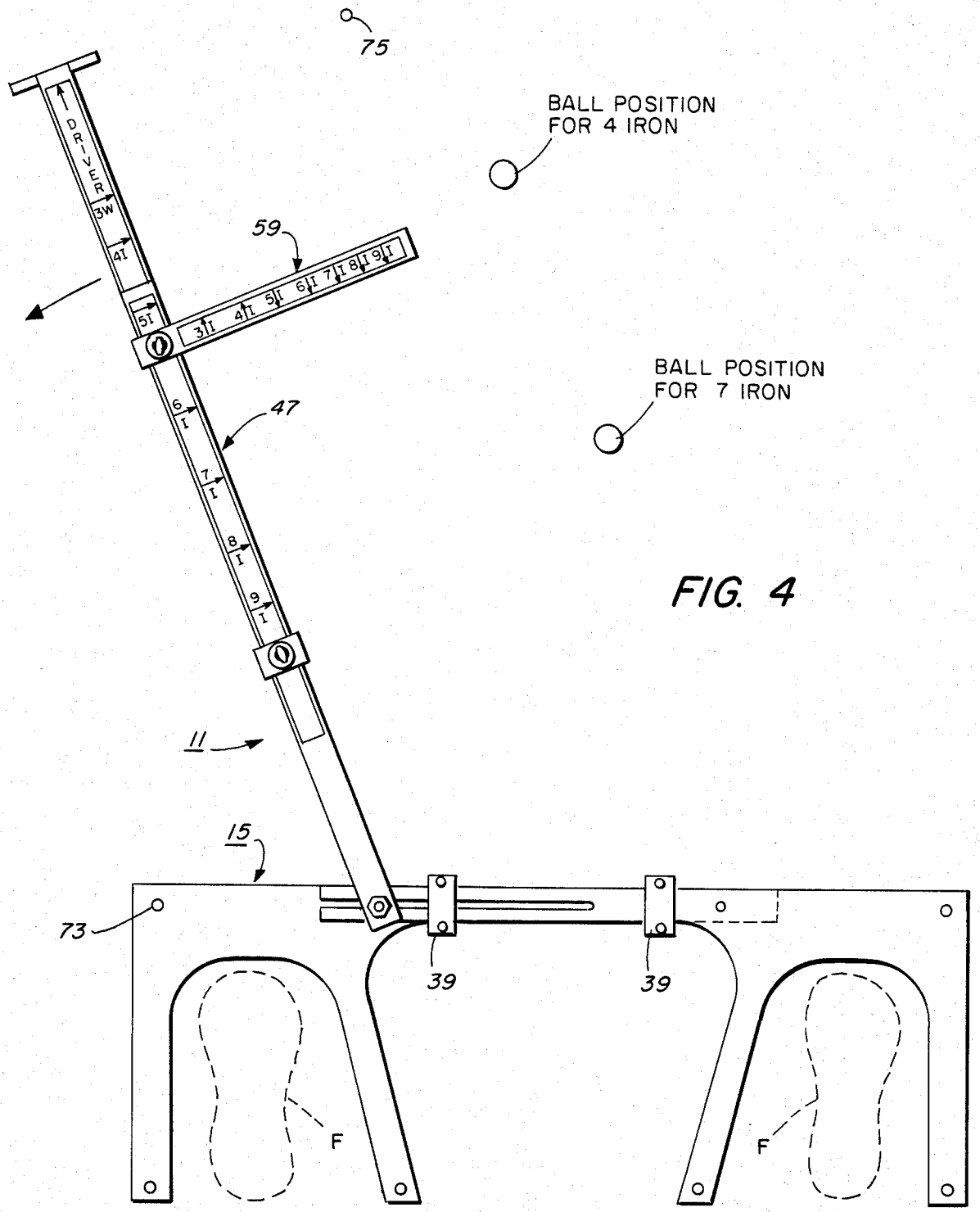
FIG. 4 is a plan view showing how the device is arranged while a ball is being hit.

With first ball marker member 47 in a partly closed (or pulled away) position, see FIG. 4, and the feet F of the golfer in the foot receiving openings, a ball is placed on the ground in front of foot positioning frame 13 at some distance along an axis passing through the pivot pin hole through which first ball marker member 47 is attached. By trial and error the proper or correct distance outward is determined for use with a driver club. Once this has been determined, first ball marker member 47 is swung out to an open (right angled) position (See FIG. 3) and its length adjusted so that the tip of the outer end is at that ball location. First ball marker member 47 is then fixed in length at that size using bracket assembly 57. To insure that first ball marker 47 may be closed and then opened again to the same position, pin 75 is inserted in the ground adjacent thereto.

First ball marker member 47 is then returned to its closed position. The proper location for the ball for each other club of interest is then determined, again by trial and error. In each instance, after the ball location has been determined, first ball marker 47 is pivoted out to its open positon, and the position recorded for that club type and size on the adhesive strips.

Golf stance guage 11 is then ready for use.

For locating the proper positon of the ball for use with the driver club, first ball marker member 47 is swung out to its open position and the ball placed at its outer end. For each one of the other clubs the ball position is located by swinging first ball marker member 47 to its open position and then using the two prerecorded markings to determine its position along two axes.

When actually hitting the ball, the first ball marker member 47 is moved to a closed position so that it will not interfer with the ball or the club.

As can be appreciated, golf training guage actually serves as a memory device.

The embodiment of the pesent invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A golf stance guage for use in assisting a golfer in learning the proper stance and distance from a golf ball for a variety of differnt golf clubs comprising:

a. a foot positioning frame adapted to rest on the ground, said foot positioning frame being adjustable in length and comprising a left frame section, being adjustable in length and comprising a left frame section, a right frame section and removable means for securing said two frame sections together, each frame section having an integrally formed open ended fixed foot receiving opening, b. a first elongated ball marker member extending outward from said foot positioning frame, said first ball marker member having an inner end and an outer end and being adjustable in length, c. means for pivotally attaching the inner end of said first ball marker member to said foot positioning frame at either one of two locations depending on whether the golfer is left handed or right handed and d. a second elongated ball marker member slidably mounted on said first ball marker member and extending laterally outward therefrom at right angles thereto, e. indicia recording means on said first and second ball marker members, f. whereby, said golf ball can be properly positioned longitudinally and laterally relative to said foot positioning frame for different golf clubs using said first and second ball marker members to record the desired position of said ball about two mutually perpendicular axes and then said first and second ball marker members pivoted out of the way so as to not be hit by the club of the golfer during his swing.

2. The golf stance guage of claim 1 and wherein said foot positioning frame has a first pivot pin hole for use in pivotally attaching thereto the first ball marker member for a right handed golfer and a second pivot pin hole for use in pivotally attaching thereto the first ball marker member for a left handed golfer.

3. The golf stance guage of claim 2 and wherein said first ball marker member includes an inner elongated member, an outer elongated member movable longitudinally relative to said inner elongated member and means for securing said outer elongated member to said inner elongated member.

4. The golf stance guage of claim 3 and wherein said second ball marker member includes a sleeve and an integrally formed marker arm.

5. The golf stance guage of claim 4 and further including means for securing said second ball marker member to said first ball marker member at a selected location along its length.

* * * * *